US009115497B2

(12) United States Patent
Morris et al.

(10) Patent No.: US 9,115,497 B2
(45) Date of Patent: Aug. 25, 2015

(54) GUTTER SCREEN ASSEMBLIES

(71) Applicant: Products Innovation Group, Inc., Rochelle, VA (US)

(72) Inventors: Anthony W. Morris, Tampa, FL (US); Evelyn M. Robins, Ruckersville, VA (US)

(73) Assignee: PRODUCTS INNOVATION GROUP INC., Rochelle, VA (US)

( * ) Notice: Subject to any disclaimer, the term of this patent is extended or adjusted under 35 U.S.C. 154(b) by 0 days.

(21) Appl. No.: 14/222,916

(22) Filed: Mar. 24, 2014

(65) Prior Publication Data

US 2015/0075084 A1 Mar. 19, 2015

Related U.S. Application Data

(60) Provisional application No. 61/877,380, filed on Sep. 13, 2013.

(51) Int. Cl.
*E04D 13/076* (2006.01)

(52) U.S. Cl.
CPC ..... *E04D 13/076* (2013.01); *E04D 13/0767* (2013.01)

(58) Field of Classification Search
CPC ..... E04D 13/076; E04D 13/0643; E04D 13/0767; E04D 2013/0413; E04D 2013/0463
USPC ..... 52/11, 12, 13, 15; 4/290, 292; 404/4; 210/162, 163, 170.03, 474; 119/527, 119/528
See application file for complete search history.

(56) References Cited

U.S. PATENT DOCUMENTS

| | | | | | |
|---|---|---|---|---|---|
| 1,582,646 | A * | 4/1926 | Flesch et al. | ..... | 210/166 |
| 3,713,539 | A * | 1/1973 | Thompson et al. | ..... | 210/164 |
| 4,261,824 | A * | 4/1981 | Cuschera | ..... | 210/164 |
| RE31,561 | E * | 4/1984 | Thompson | ..... | 4/290 |
| 4,487,690 | A * | 12/1984 | Logsdon | ..... | 210/163 |
| D355,707 | S * | 2/1995 | Emanuele et al. | ..... | D23/259 |
| 5,462,383 | A * | 10/1995 | Van 'T Veer | ..... | 404/4 |
| 5,618,416 | A * | 4/1997 | Haefner | ..... | 210/163 |
| 6,883,760 | B2 * | 4/2005 | Seise, Jr. | ..... | 248/48.1 |
| 7,144,185 | B2 * | 12/2006 | Messerschmidt et al. | ..... | 404/4 |
| 7,413,372 | B2 * | 8/2008 | Meyers | ..... | 404/2 |
| 7,524,414 | B1 * | 4/2009 | Barragan | ..... | 210/163 |
| 7,765,743 | B2 | 8/2010 | Guilford | | |

(Continued)

FOREIGN PATENT DOCUMENTS

| | | | | |
|---|---|---|---|---|
| EP | 46743 A1 * | 3/1982 | ..... | E03C 1/084 |
| GB | 2209782 A * | 5/1989 | ..... | E01C 11/22 |

*Primary Examiner* — Robert Canfield
(74) *Attorney, Agent, or Firm* — Nixon & Vanderhye, PC

(57) ABSTRACT

A screen assembly for receiving high volumes of water flowing from a roof to a gutter. The screen assembly has a first support frame having an upstanding rim extending around a periphery thereof and being construed to be mounted on the gutter and secured to an adjacent portion of a roof fascia. The first support frame has an opening in a bottom surface thereof that is constructed to be disposed over a gutter opening when the first support frame is mounted on the gutter. The screen assembly has a second support frame having a screen secured thereto and extending over the second support frame. The second support frame has a shape corresponding to that of the first support frame and is mounted thereon in close relationship to and within the upstanding rim of the first support frame, the second support frame being connected to the upstanding rim.

8 Claims, 8 Drawing Sheets

(56) References Cited

U.S. PATENT DOCUMENTS

| | | | | |
|---|---|---|---|---|
| 7,805,889 | B2 * | 10/2010 | Barnett | 52/12 |
| 7,820,041 | B2 * | 10/2010 | Hilton et al. | 210/163 |
| 7,964,095 | B1 * | 6/2011 | Graybeal | 210/164 |
| 2002/0152691 | A1 * | 10/2002 | Wade | 52/11 |
| 2004/0005192 | A1 * | 1/2004 | Chapek | 405/39 |
| 2005/0115160 | A1 * | 6/2005 | Brochu | 52/11 |
| 2006/0123710 | A1 * | 6/2006 | Lenney et al. | 52/12 |
| 2006/0230687 | A1 * | 10/2006 | Ealer | 52/12 |
| 2007/0180605 | A1 * | 8/2007 | Griffin et al. | 4/507 |
| 2008/0017562 | A1 * | 1/2008 | Tripodi et al. | 210/163 |
| 2009/0101553 | A1 * | 4/2009 | Lucas | 210/164 |
| 2009/0107053 | A1 * | 4/2009 | Guilford | 52/12 |
| 2010/0133138 | A1 * | 6/2010 | Fox | 206/459.5 |
| 2011/0265390 | A1 * | 11/2011 | Brochu | 52/12 |
| 2012/0110922 | A1 * | 5/2012 | Hawes | 52/12 |
| 2012/0192502 | A1 * | 8/2012 | Glander | 52/12 |

* cited by examiner

GUTTER SCREEN ASSEMBLIES

This application claims the priority of Provisional Application No. 61/877,380 filed on Sep. 13, 2013 and entitled "GUTTER SCREEN ASSEMBLY".

BACKGROUND OF THE INVENTION

1. Field of the Invention

This invention relates to a screen assembly for rain gutters and, more particularly, to a screen assembly especially suited for use at the inside corners of rain gutters or in areas of rain gutters exposed to high volumes of water, e.g., near downspouts from second stories or the like, "bar areas" or outside miters.

2. Description of Background Art

Rain gutters are in common use on building structures to control the run off of water from the roof of the associated building. Problems arise with respect to the collection of debris in the gutters and with respect to water cascading off of the roof of the structure and falling onto the ground below. The cascading water problem is particularly acute in inside corner situations where water cascades down the corner valley formed where two different surfaces of the roof intersect and also in areas of the gutters exposed to high volumes of water flow.

Various assemblies have been proposed to address the problem of debris accumulation and the cascading problem in inside corner and high volume scenarios, but none of the proposed assemblies have been totally satisfactory.

U.S. Pat. No. 7,765,743 discloses a screen assembly for an inside rain gutter course that is an improvement over prior assemblies and is effective in catching cascading water at inside corners of rain gutters. This assembly, however, is subject to certain disadvantages that result from the inner portion of the screen being unsupported and positioned under the adjacent shingles at the roof corner. The screen itself has no load strength and the breach of the adjacent shingles is undesirable. Also, the parallel nature of the screen as it relates to the shingles, especially on steep roofs, enables the cascading water to skid further and have the potential for overshoot, even with the extended distance of the screen assembly at the inside corner of the gutters.

SUMMARY OF THE INVENTION

In one embodiment of the present invention constructed for installation at the inside corners of rain gutters, the screen assembly comprises a first support frame having an upstanding rim extending around the upper surface thereof. The first support frame has an angled opening therethrough that corresponds to the corner gutter areas on which it is to be installed.

The first support frame comprises an outer rim portion constructed to extend across the gutters outwardly from the inside corners thereof, side rim portions extending over the gutters and inner rim portions constructed to engage the adjacent fascia at the roof corner.

A screen is mounted on a second support frame having the shape of the first support frame and constructed to be received within the first support frame. The screen is secured to the first support frame by screws or the like extending through the outer and side rims of the first support frame and into the adjacent portions of the second support frame supporting the screen. In order to support the screen and prevent it from collapsing when exposed to snow or debris loads, the first support frame is provided with upstanding panels for engaging the screen when it is mounted in the first frame. The inside rim portions of the first support frame are secured to the adjacent fascia at the roof corner by screws or the like, and the bottom surface of the first support frame at the outer portion thereof is secured to the underlying front lips of the gutters by screws or the like to securely position the screen assembly at the inside corners of the gutters.

In a second embodiment of the present invention constructed for installation over a straight gutter portion that is exposed to high volumes of water, e.g., near downspouts from second stories or the like, the screen assembly has a first support frame with an upstanding rim and an opening therethrough that is positioned over the gutter opening when the screen assembly is installed thereon. In the second embodiment, the first support frame has a straight inner portion that is constructed to be secured to the adjacent roof fascia by screws or the like, side rim portions that are constructed to extend over the gutter, and a front rim portion extending outwardly from the gutter to catch high volumes of water. In a manner similar to the first embodiment, the screen is mounted on a second support frame that fits within the first support frame and can be secured thereto by screws or the like. Also, the first support frame comprises raised panels for supporting the screen when it is mounted in the first support frame to prevent it from collapsing under heavy loads.

DETAILED DESCRIPTION OF THE INVENTION

FIGS. 1-5 illustrate a first embodiment of the present invention in the nature of a screen assembly for use at the inside corners of rain gutters. The screen assembly 10 comprises a first support frame 12 (FIG. 3) having an upstanding rim 14 extending around the periphery thereof, and an angled opening 16 therethrough which corresponds to the openings at the corner of the gutters G shown in FIGS. 4 and 5. The first support frame 12 may be formed of any suitable material such as aluminum.

Figure 2:
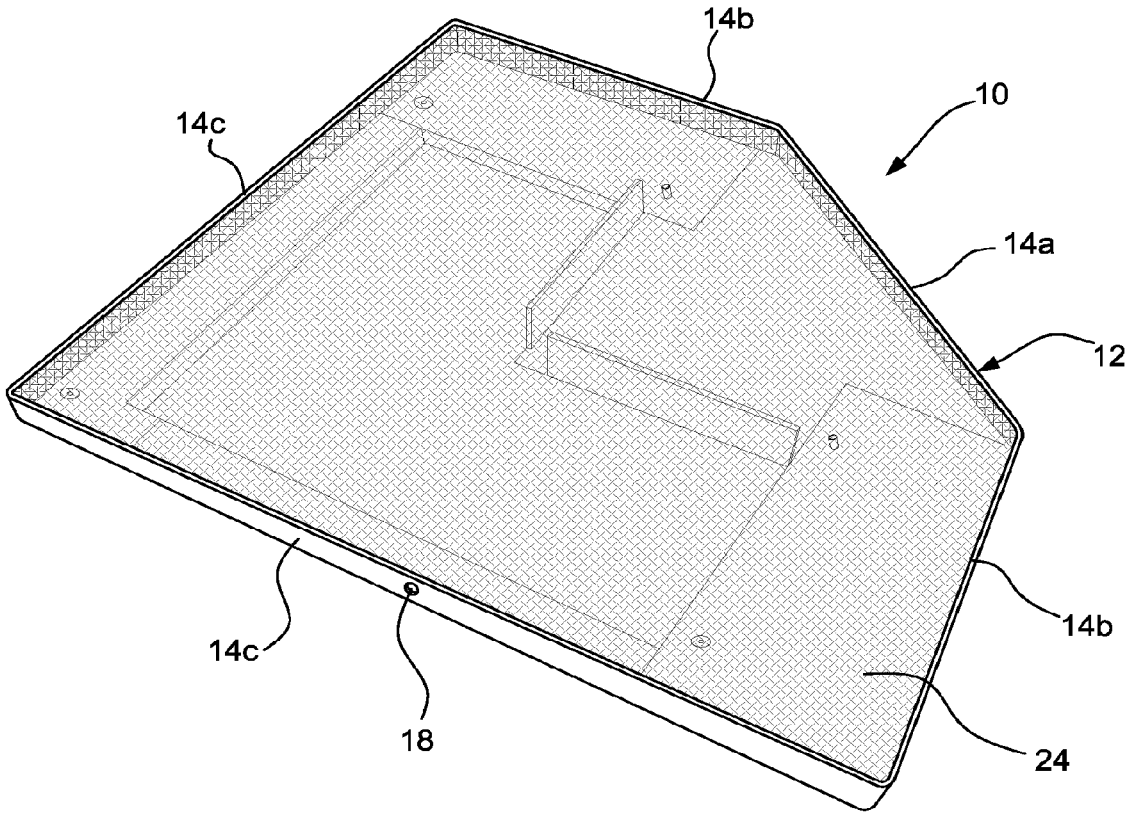
FIG. 2 is a perspective view of the screen assembly of FIG. 1 in a different orientation.

The rim 14 comprises an outer rim portion 14*a* that is constructed to extend across the gutters G in outwardly spaced relation to the corners thereof (FIGS. 4 and 5), side rim portions 14*b* constructed to extend across the gutters in spaced relation to the corners thereof (FIGS. 4 and 5), and inner rim portions 14*c* that are constructed to be positioned adjacent to the fascia at the corner of the roof where the gutters G are installed. As shown in FIG. 2, the inner rim portions 14*c* are provided with one or more apertures 18 for receiving a screw to secure the first support frame to the roof fascia. The first support frame 12 also has apertures (not shown) through the bottom surface 20 thereof for receiving screws 22 to secure the first support frame to the adjacent front lips of the underlying gutters G, as shown in FIG. 5.

Figure 1:
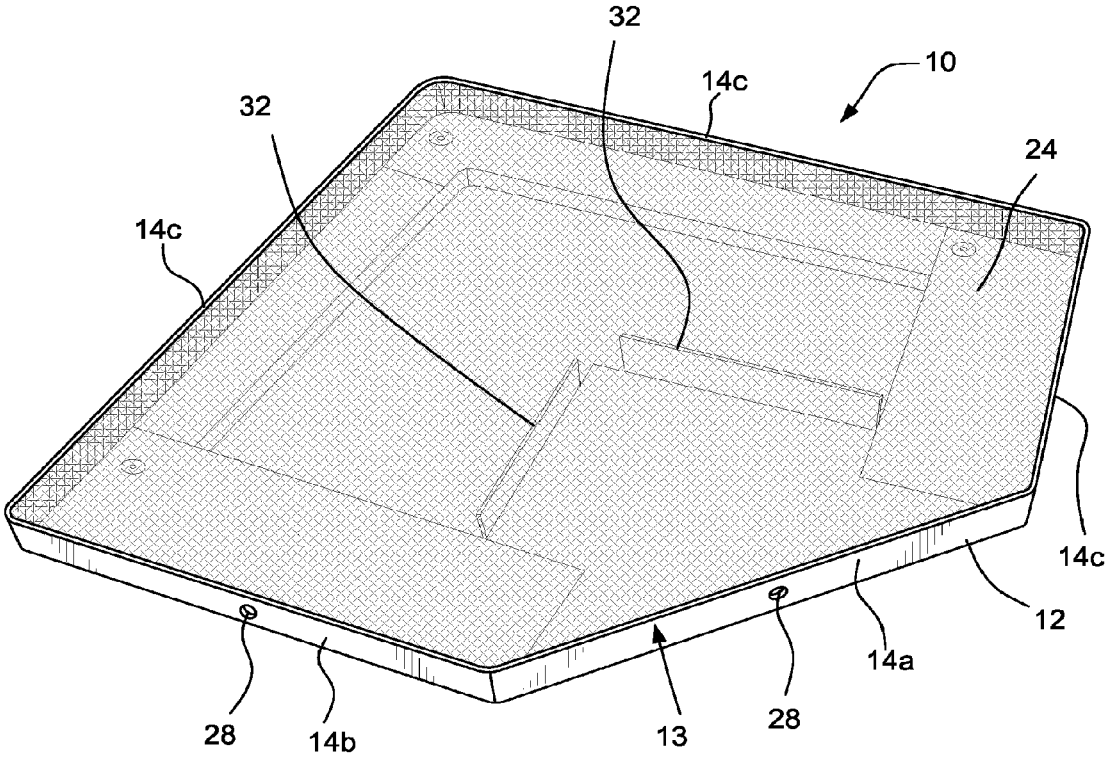
FIG. 1 is a perspective view of a first embodiment of the screen assembly of the present invention.
Figure 3:
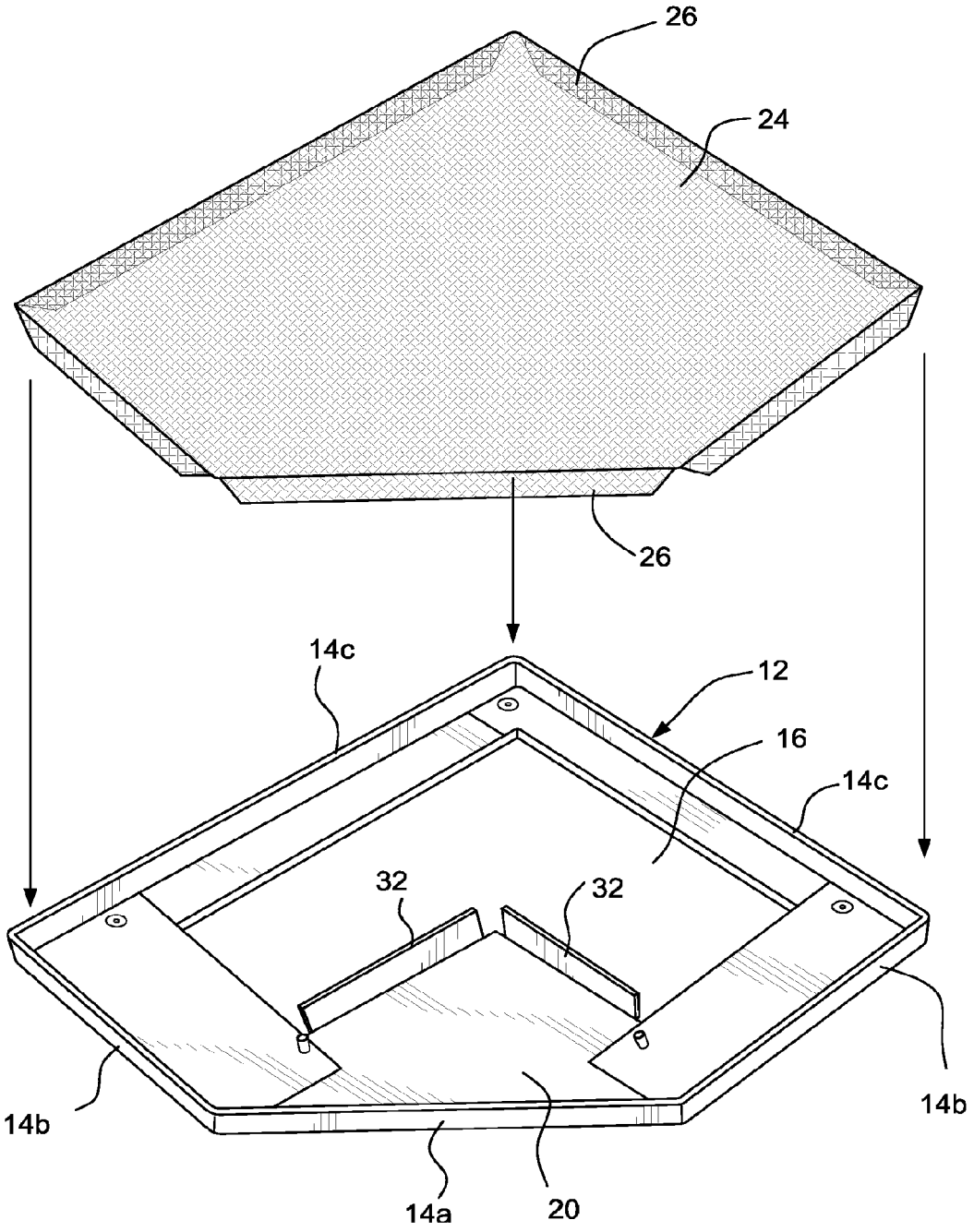
FIG. 3 is a perspective view of the component parts of the screen assembly shown in FIGS. 1 and 2.

Referring to FIG. 3, a screen 24 is mounted on a second support frame 26 having a shape corresponding to that of the first support frame 12 and being constructed to fit within the rim 14 of the first support frame in close relation to the rim as shown in FIGS. 1 and 2. The side rim portions 14*a* and 14*b* of the first support frame 12 are provided with apertures 28 therethrough for receiving screws 30 therethrough to connect the first support frame 12 to the second support frame 26 and securely mount the screen 24 over the first support frame 12 and angled opening 16 therethrough, as shown in FIGS. 4 and 5.

The screen 24 may be of any suitable mesh size and may be formed of any suitable material such as a stainless steel woven mesh. Expanded metal screens or any perforated type insert can also be utilized. The second support frame 26 may be formed of any suitable material such as aluminum.

To support the screen 24 and prevent it from collapsing under heavy loads, the bottom surface 20 of the first support frame 12 is provided with an upstanding panel or panels 32 in a center portion thereof that engage the lower surface of the screen 24 when it is positioned on the first support frame 12.

Figure 4:
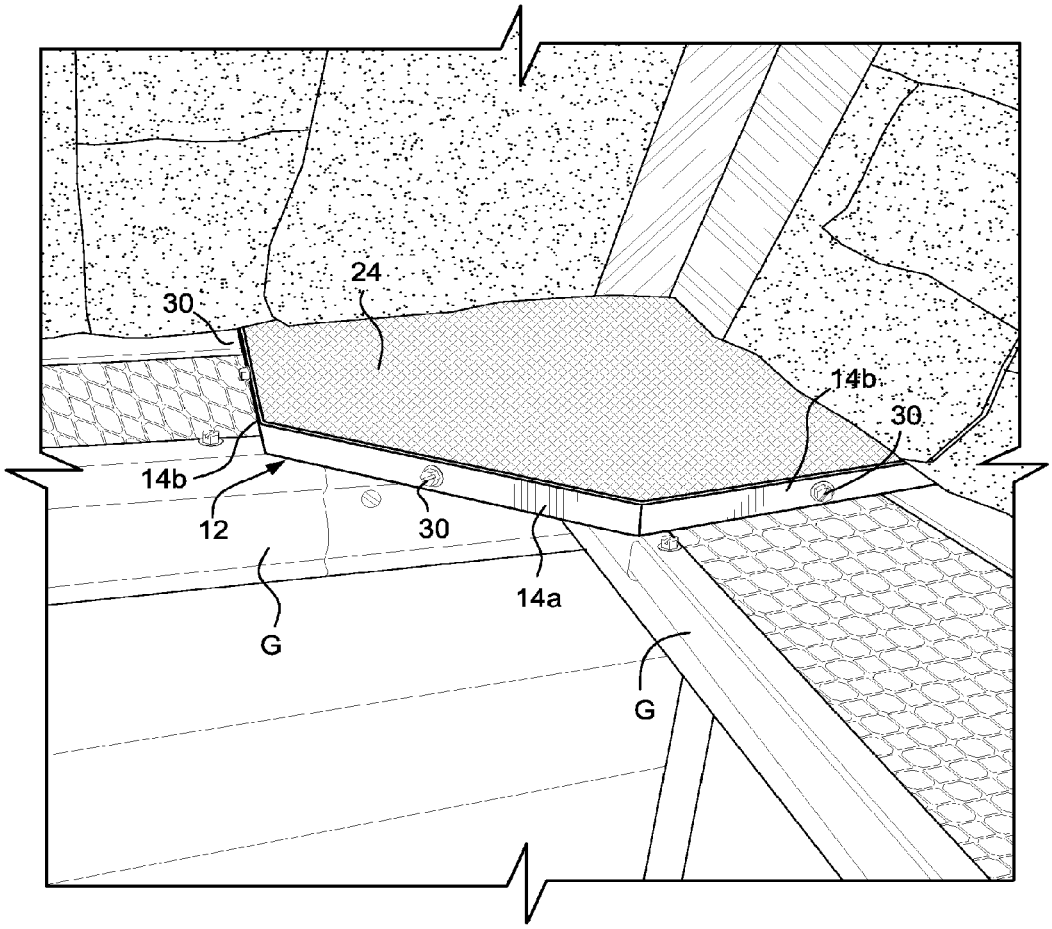
FIG. 4 is a perspective view of the first embodiment of the screen assembly installed over the inside of the corners of gutters.
Figure 5:
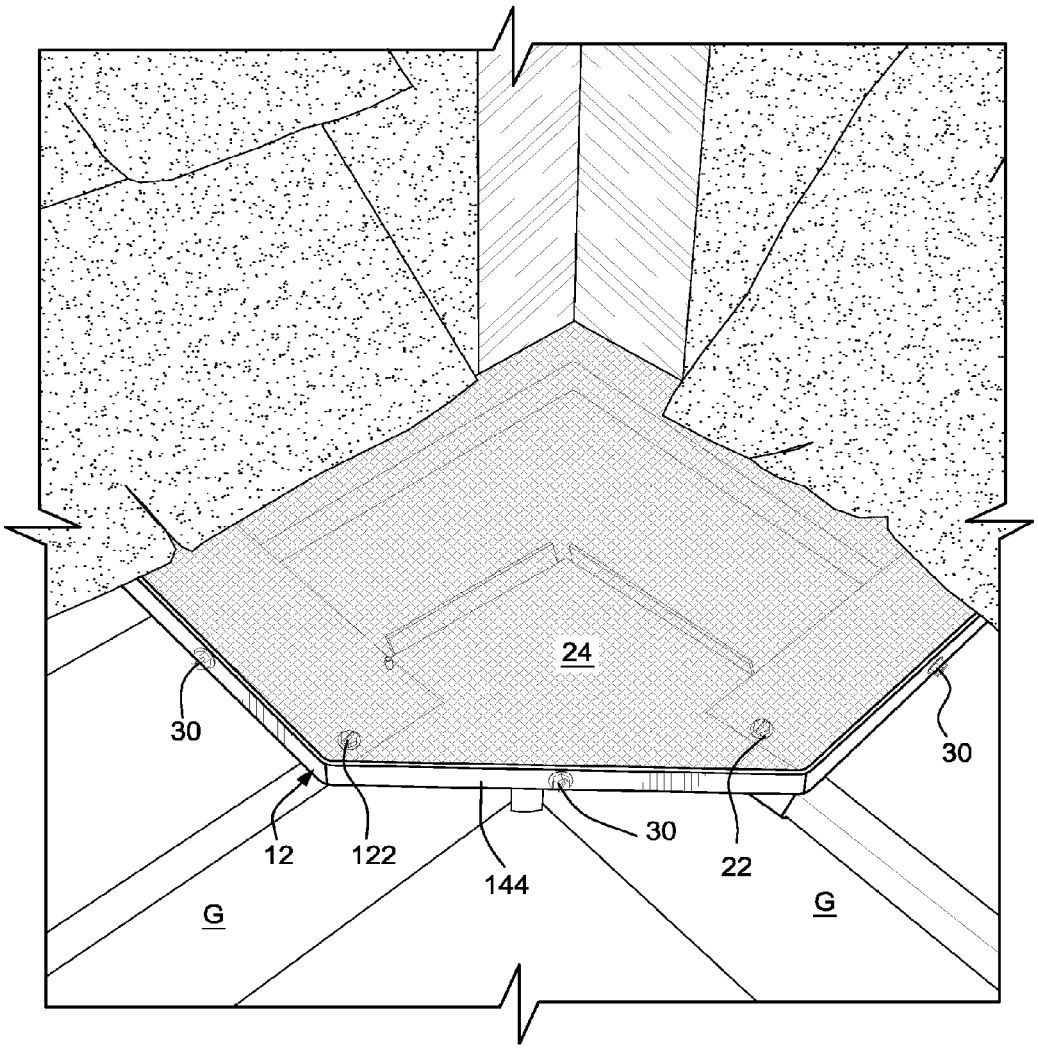
FIG. 5 is another perspective view of the first embodiment of the screen assembly installed over the corners of the gutters.

In the installation of the screen assembly 10 on the corners of the gutters G, the first support frame 12 is positioned over the corners of the gutters G as shown in FIGS. 4 and 5. The first support frame 12 is then connected by screws or the like through the openings 18 in the inner rim portions 14*c* to the adjacent portions of the roof fascia (not shown). The first support frame 12 is also connected by the screws 22 or the like to the adjacent front lips of the gutters G as shown in FIG. 5.

Thereafter, the second support frame 26 is positioned within the first support frame so that the screen 24 extends across the first support frame 12. The first support frame 12 is then secured to the second support frame 26 by the screws 30 or the like extending through the openings 28 in the outer and side rim portions 14*a* and 14*b*, as shown in FIGS. 1, 4 and 5.

Figure 6:
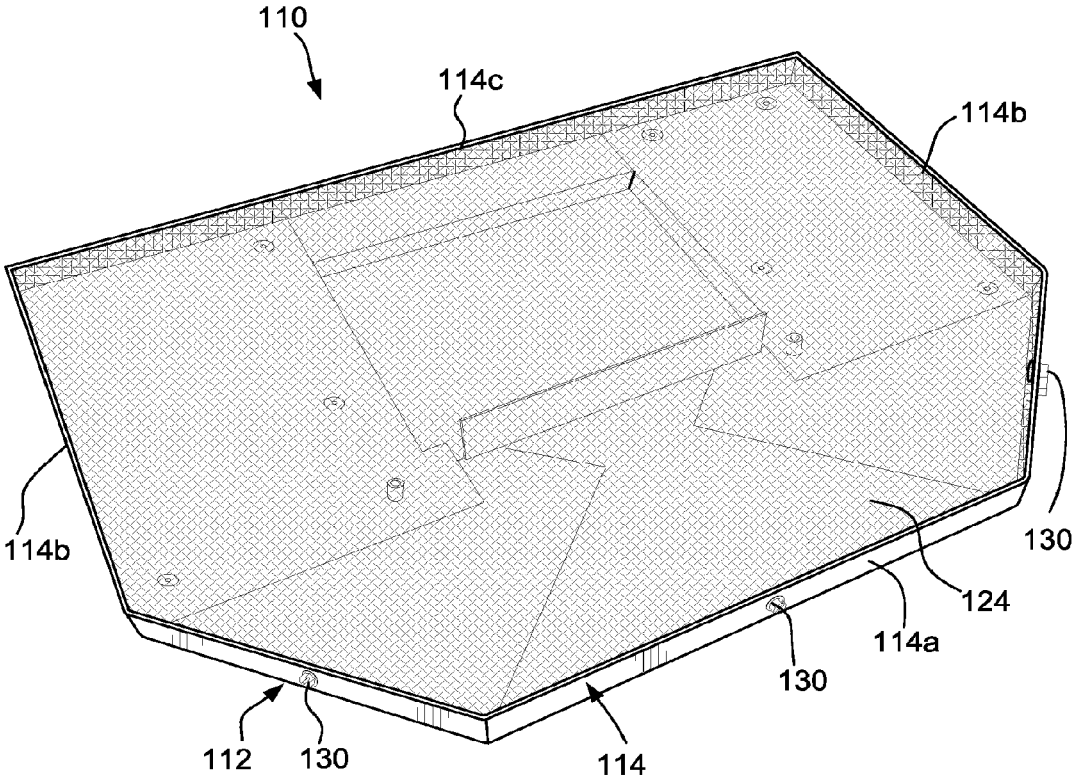
FIG. 6 is perspective view of a second embodiment of the screen assembly of the present invention.
Figure 7:
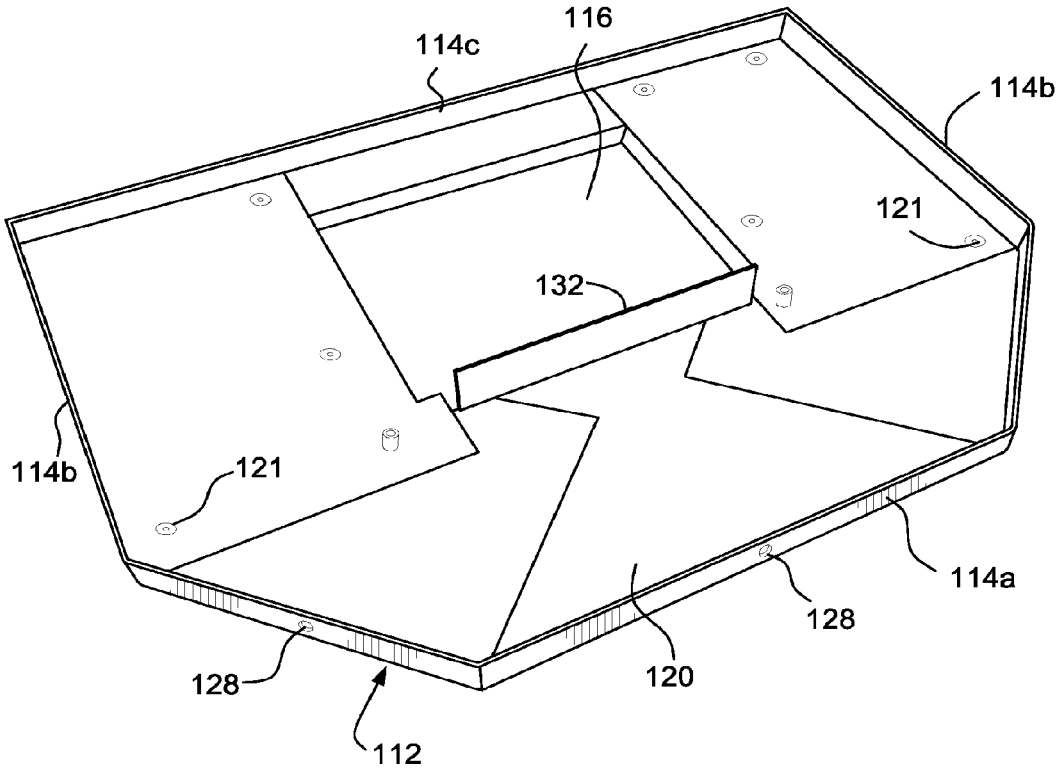
FIG. 7 is a perspective view of the underlying first support frame of the screen assembly of FIG. 6.
Figure 8:
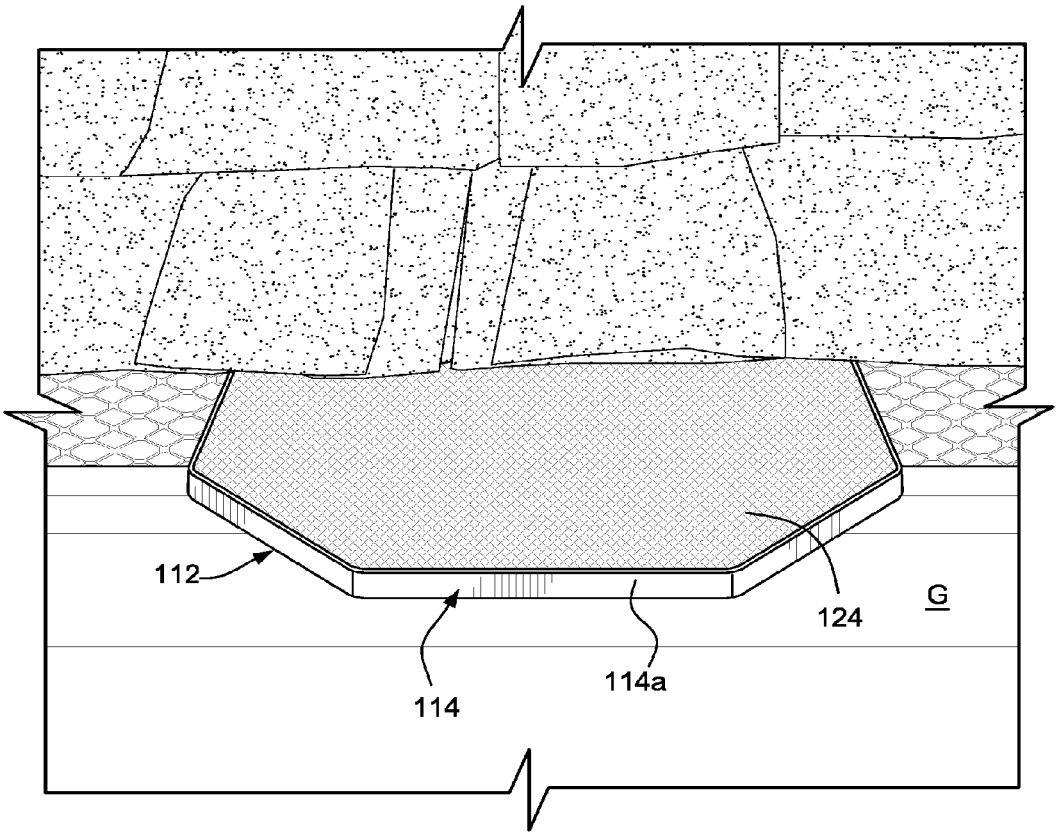
FIG. 8 is a perspective view of the second embodiment of the screen assembly installed over a straight gutter section.

FIGS. 6-8 illustrate a second embodiment of a screen assembly 110 for installation over a straight section of gutter G that is exposed to high volumes of water, e.g., near downspouts from second stories or the like. The construction of the screen assembly 110 is very similar to that of the first screen assembly 10 in that the screen 124 mounted on a second support frame (not shown) is positioned within the upstanding rim 114 of the first support frame 112 and secured thereto by any suitable means such as screws (not shown) extending through apertures 128 in the outer portion 114*a* of the upstanding rim 114 of the first support frame 112.

Referring to FIG. 7, the first support frame 112 has an outer rim portion 114*a*, side rim portions 114*b* and an inner rim portion 114*c*. Apertures 128 are provided in the outer rim portion 114*a* for receiving the screws 130 to secure the screen 124 and second support frame to the first support frame 112 in the same manner as the screen assembly 10 shown in FIGS. 1-5. The first support frame 112 has a bottom surface 120 with an opening 116 therethrough that is constructed to be positioned over the gutter opening when the screen assembly 110 is mounted on the gutter. The inner rim portion 114*c* is provided with apertures (not shown) therethrough for receiving screws to secure it to the adjacent fascia portion of the roof when the first support frame 112 is positioned on the gutter G, as shown in FIG. 8. The bottom surface 120 of the first support frame 112 comprises apertures 121 in suitable locations for receiving screws (not shown) to secure the first support frame 112 to the adjacent portions of the front lip of the gutter G. The lower surface 120 of the first support frame 112 comprises an upstanding panel 132 for supporting the screen 124 and preventing it from collapsing when subjected to heavy loads.

As shown in FIG. 8, when the first support frame 112 is mounted on the gutter G, the outer rim portion 114*a* and overlying screen 124 extend outwardly from the gutter to catch high volumes of water flow.

From the foregoing description, it will be readily seen that the embodiments of the screen assembly of the present invention are simple in construction, easily installed on straight or corner sections of gutters in a secure manner, and are effective in catching high volumes of water flow in corner or straight sections of gutters.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A screen assembly for receiving high volumes of water flowing from a roof to a gutter, the screen assembly comprising:

a first support frame having an upstanding rim extending around an entire periphery thereof and being constructed to be mounted on the gutter and secured to an adjacent portion of a roof fascia, the first support frame having an opening in a bottom surface thereof that is constructed to be disposed over a gutter opening when the first support frame is mounted on the gutter, a second support frame having a screen secured thereto and extending over the second support frame, the second support frame having a rim extending around an entire periphery thereof for supporting the screen, the rim of the second support frame having a shape corresponding to that of the rim of the first support frame and being mounted thereon in close relationship to and within the upstanding rim of the first support frame, the rim of the second support frame being connected to the upstanding rim of the first support frame, wherein the first support frame is mounted on the inside corner of gutters, the upstanding rim comprising an outer rim portion extending across the gutters and being spaced outwardly from the corner thereof, side rim portions extending from the outer rim portion to a portion of an adjacent roof fascia, and inner time portions engaging the roof fascia at the corner of the gutters being secured thereto.

2. The screen assembly of claim 1 wherein the first support frame has an upstanding portion extending upwardly from a bottom surface thereof for supporting the screen and preventing it from collapsing under heavy loads.

3. The screen assembly of claim 2 wherein the upstanding portion is an upstanding panel located in a center portion of the first support frame.

4. The screen assembly of claim 3 wherein a plurality of upstanding panels are located on the bottom surface of the first support frame.

5. The screen assembly of claim 1, wherein the upstanding rim of the first support frame has apertures therethrough and screws extend through the apertures to connect the upstanding rim to the rim of the second support frame.

6. The screen assembly of claim 1 wherein the first support frame has a bottom surface with apertures therethrough for receiving screws or other connecting members to be connected to an adjacent portion of the gutter when the first support frame is mounted thereon.

7. The screen assembly of claim 1 wherein the opening in the bottom surface of the first support frame is angled so as to be disposed over the comer gutter opening.

8. A screen assembly for receiving high volumes of water flowing from a roof to a gutter, the screen assembly comprising:

a first support frame having an upstanding rim extending around an entire periphery thereof and being constructed to be mounted on the gutter and secured to an adjacent portion of a roof fascia, the first support frame having an opening in a bottom surface thereof that is constructed to be disposed over a gutter opening when the first support frame is mounted on the gutter, a second support frame having a screen secured thereto and extending over the second support frame, the second support frame having a rim extending around an entire periphery thereof for supporting the screen, the rim of the second support frame having a shape corresponding to that of the rim of the first support frame and being mounted thereon in close relationship to and within the upstanding rim of the first support frame, the rim of the second support frame being connected to the upstanding rim of the first support frame, wherein the first support frame is mounted on a straight gutter and the upstanding rim comprises an outer rim portion extending outwardly from the gutter, side rim portions extending from the outer rim portion over the gutter to an adjacent fascia portion of the roof, and an inner rim portion connected to the adjacent roof fascia portion.

* * * * *